US011193287B2

(12) United States Patent
Tan

(10) Patent No.: US 11,193,287 B2
(45) Date of Patent: Dec. 7, 2021

(54) CONSTRUCTION SYSTEM AND METHOD

(71) Applicant: SH TECHNOLOGIES PTE LTD, Singapore (SG)

(72) Inventor: Yeow Khoon Tan, Singapore (SG)

(73) Assignee: SH TECHNOLOGIES PTE LTD, Singapore (SG)

( * ) Notice: Subject to any disclaimer, the term of this patent is extended or adjusted under 35 U.S.C. 154(b) by 136 days.

(21) Appl. No.: 16/317,431

(22) PCT Filed: Sep. 21, 2017

(86) PCT No.: PCT/SG2017/050477
§ 371 (c)(1),
(2) Date: Jan. 11, 2019

(87) PCT Pub. No.: WO2018/056906
PCT Pub. Date: Mar. 29, 2018

(65) Prior Publication Data

US 2019/0242144 A1 Aug. 8, 2019

(30) Foreign Application Priority Data

Sep. 23, 2016 (SG) ..... 10201607958X

(51) Int. Cl.
*E04G 21/14* (2006.01)
*B66F 9/18* (2006.01)
(Continued)

(52) U.S. Cl.
CPC ..... *E04G 21/142* (2013.01); *B66C 1/66* (2013.01); *B66F 9/087* (2013.01); *B66F 9/125* (2013.01); *B66F 9/18* (2013.01); *E04B 1/20* (2013.01)

(58) Field of Classification Search
CPC ..... B66C 1/663; B66C 1/66; E04G 21/28; E04G 21/142; E04G 21/16; B66F 9/087; B66F 9/125; B66F 9/18
(Continued)

(56) References Cited

U.S. PATENT DOCUMENTS 1,648,724 A * 11/1927 Dakin ..... E04G 21/242 52/63
1,886,945 A * 11/1932 D Humy ..... E04H 6/08 52/174
(Continued)

FOREIGN PATENT DOCUMENTS

CN 205153562 U 4/2016
DE 1684153 U * 9/1954
(Continued)

OTHER PUBLICATIONS

International Search Report, Written Opinion and International Preliminary Report on Patentability of International Application No. PCT/SG2017/050477, dated Oct. 2, 2017.
(Continued)

*Primary Examiner* — Robert Canfield
(74) *Attorney, Agent, or Firm* — Sterne, Kessler, Goldstein & Fox P.L.L.C.

(57) ABSTRACT

A system for assembling a plurality of pre-fabricated components to form a structure comprising: a first lifting device for transporting at least one pre-fabricated component from a source to a designated site; a second lifting device for engaging the at least one pre-fabricated component at the designated site; wherein the second lifting device comprises an engagement means to engage a portion of the at least one pre-fabricated component for installation at the designated site, and wherein the engagement means is capable of moving the engaged pre-fabricated component in at least
(Continued)

two degrees of motion, is disclosed. In some embodiments, the engagement means comprises a plurality of locks.

16 Claims, 13 Drawing Sheets

(51) Int. Cl.
*E04B 1/20* (2006.01)
*B66C 1/66* (2006.01)
*B66F 9/08* (2006.01)
*B66F 9/12* (2006.01)

(58) Field of Classification Search
USPC ..... 52/236.3, 745.1, 745.11, 745.12, 745.13, 52/745.2, 79.5; 414/10–13, 23, 607, 414/618–621, 628, 629
See application file for complete search history.

(56) References Cited

U.S. PATENT DOCUMENTS 2,497,887 A * 2/1950 Hilpert ..... E04B 1/35 52/99
2,693,289 A * 11/1954 Ulinski ..... B66F 9/18 414/621
2,722,327 A * 11/1955 Gault ..... B66F 9/18 414/621
2,795,346 A * 6/1957 Farmer ..... B66F 9/183 414/621
2,837,776 A * 6/1958 Klein ..... E04B 1/3404 52/73
2,957,594 A * 10/1960 Brenneman ..... B66F 9/147 414/607
3,007,541 A * 11/1961 Mast, Jr. ..... E04G 21/242 182/112
3,050,206 A * 8/1962 McCracken ..... B66F 9/12 414/607
3,148,909 A * 9/1964 Tantlinger ..... B65D 90/0026 294/81.41
3,207,348 A * 9/1965 Olson ..... B66F 9/181 414/627
3,361,280 A * 1/1968 Traver ..... B66F 9/181 414/627
3,387,729 A * 6/1968 Hindin ..... B66F 9/186 414/608
3,409,158 A * 11/1968 Lull ..... B66F 9/127 414/639
3,429,092 A * 2/1969 Hart ..... E04B 1/20 52/653.1
3,438,162 A * 4/1969 Graham ..... E04H 1/04 52/175
3,455,476 A * 7/1969 Grigsby ..... B66F 9/18 414/607
3,480,069 A * 11/1969 Handwerker ..... E04G 21/28 160/354
3,530,626 A * 9/1970 Mezes ..... E04B 1/04 52/204.1
3,556,328 A * 1/1971 Miles ..... B66F 9/149 414/607
3,586,126 A * 6/1971 Eickhof ..... E04G 21/28 182/129
3,593,672 A * 7/1971 Breen ..... B66F 9/18 410/129
3,708,933 A * 1/1973 Yang ..... E04B 1/34315 52/236.4
3,748,805 A * 7/1973 Boros ..... E04B 1/35 52/745.13
3,752,346 A * 8/1973 Thompson ..... B66F 9/186 414/608
3,762,110 A * 10/1973 Boss, Jr. ..... E04G 21/28 52/63
3,805,816 A * 4/1974 Nolte ..... E04G 21/242 135/115
3,813,835 A * 6/1974 Rice ..... E04H 6/10 52/223.7
3,850,322 A * 11/1974 Miles ..... B66F 9/149 414/607
3,881,617 A * 5/1975 Miller ..... B66F 9/19 414/422
3,921,362 A * 11/1975 Ortega ..... E04B 1/3538 52/745.14
3,923,167 A * 12/1975 Blankenbeckler ..... B25H 1/00 414/11
3,926,318 A * 12/1975 Kister ..... B66C 1/666 414/11
3,949,834 A * 4/1976 Nusbaum ..... E04G 21/3261 182/138
3,950,913 A * 4/1976 Mori ..... E01D 19/14 14/77.3
4,059,931 A * 11/1977 Mongan ..... E04B 1/22 52/79.12
4,087,947 A * 5/1978 Turner ..... E04G 15/04 294/90
4,095,714 A * 6/1978 Schuster ..... B66F 9/125 414/607
4,129,197 A * 12/1978 Preston ..... E04G 21/3223 182/82
4,230,434 A * 10/1980 Seaberg ..... B66F 9/12 292/207
4,402,543 A * 9/1983 Simpson ..... B66F 9/186 294/81.53
4,555,890 A * 12/1985 Gartner ..... E04B 1/35 52/745.11
4,671,721 A * 6/1987 Pratt ..... B66C 1/666 294/67.1
4,676,713 A * 6/1987 Voelpel ..... B65G 49/061 414/590
4,802,813 A * 2/1989 Perry ..... B66F 9/12 414/607
4,824,318 A * 4/1989 Dones ..... B66F 9/186 294/81.1
4,875,549 A * 10/1989 Denny ..... E04G 21/28 182/138
5,038,889 A * 8/1991 Jankowski ..... E04G 21/28 182/129
5,052,734 A * 10/1991 Hasegawa ..... B66C 1/663 294/81.2
5,114,294 A 5/1992 Attman
5,127,791 A * 7/1992 Attman ..... B66F 9/0655 414/10
5,141,387 A * 8/1992 Smith ..... B66F 9/125 294/201
5,163,726 A * 11/1992 Boos ..... B66C 1/663 294/67.1
5,383,758 A * 1/1995 Patrick ..... B66F 9/061 414/10
5,429,490 A * 7/1995 Myers ..... B28B 7/08 294/67.33
5,749,186 A * 5/1998 Kaufman ..... E04H 6/10 52/174
5,863,169 A 1/1999 Inkeroinen
5,881,504 A * 3/1999 Wakisaka ..... B66C 23/283 52/123.1
6,431,379 B1 * 8/2002 Kroll ..... B66C 1/101 212/319
6,921,240 B2 * 7/2005 Moore ..... B66F 9/18 414/607
9,038,274 B2 * 5/2015 Koivunen ..... E02D 5/30 29/897.3
9,139,405 B2 * 9/2015 Balcom ..... B66F 9/12
9,663,961 B2 * 5/2017 Moeller ..... E04G 21/167
9,676,601 B2 * 6/2017 Magni ..... B66F 9/0655
10,100,541 B1 * 10/2018 Widjaja ..... E04G 21/168
10,174,878 B2 * 1/2019 Kaytes ..... F16M 11/42
10,501,933 B2 * 12/2019 Stroyer ..... E04B 2/7453
2004/0068944 A1 * 4/2004 Dalton ..... E04B 1/161 52/236.9
2005/0161654 A1 * 7/2005 Ancell ..... B66F 9/18 254/334

(56) References Cited

U.S. PATENT DOCUMENTS

| | | | | |
|---|---|---|---|---|
| 2006/0062655 | A1* | 3/2006 | Harrelson | E04G 21/167 414/10 |
| 2006/0101782 | A1* | 5/2006 | Sanders | E04G 21/168 52/749.1 |
| 2007/0201972 | A1* | 8/2007 | Tsuji | B60K 17/22 414/718 |
| 2008/0292440 | A1* | 11/2008 | Hiltscher | B66C 19/007 414/567 |
| 2009/0226282 | A1* | 9/2009 | Starr | E04B 7/028 414/10 |
| 2011/0239583 | A1 | 10/2011 | Mateu | |
| 2011/0289862 | A1* | 12/2011 | Larouche | E04G 13/02 52/122.1 |
| 2018/0340331 | A1* | 11/2018 | Stroyer | E04B 2/7836 |

FOREIGN PATENT DOCUMENTS

| | | | | |
|---|---|---|---|---|
| DE | 1684153 | A1 * | 3/1971 | E04G 21/28 |
| DE | 2708788 | B1 | 5/1978 | |
| EP | 358433 | A2 * | 3/1990 | |
| EP | 890543 | A2 * | 1/1999 | B66B 1/663 |
| EP | 1886964 | A2 * | 2/2008 | B66F 9/183 |
| EP | 2140754 | A1 | 1/2010 | |
| GB | 2154643 | A | 9/1985 | |
| GB | 2201658 | A * | 9/1988 | B29C 31/006 |
| GB | 2272881 | A * | 6/1994 | B66F 9/186 |
| JP | 02110100 | A * | 4/1990 | |
| JP | 02163295 | A * | 6/1990 | |
| JP | H03119256 | A | 5/1991 | |
| JP | 04047072 | A * | 2/1992 | |
| JP | H04185869 | A | 7/1992 | |
| JP | 07215655 | A * | 8/1995 | |
| JP | H08135196 | A | 5/1996 | |
| JP | H08189191 | A | 7/1996 | |
| JP | 2003026397 | A | 1/2003 | |
| JP | 2005171593 | A | 6/2005 | |
| WO | 9919583 | A1 | 4/1999 | |
| WO | WO-2014162323 | A1 * | 10/2014 | A61M 1/14 |
| WO | WO-2017135851 | A1 * | 8/2017 | B66C 13/14 |

OTHER PUBLICATIONS

Extended European Search Report for European Application No. 17853552.2-1005.

* cited by examiner

CONSTRUCTION SYSTEM AND METHOD

FIELD OF THE INVENTION

The invention relates to a construction system and method. The system and method are suitable for, but not limited to the assembly of a plurality of pre-fabricated components such as slabs or columns to form or construct one or more structures, buildings or the like and will be described in such context.

BACKGROUND ART

The following discussion of the background to the invention is intended to facilitate an understanding of the present invention only. It should be appreciated that the discussion is not an acknowledgement or admission that any of the material referred to was published, known or part of the common general knowledge of the person skilled in the art in any jurisdiction as at the priority date of the invention.

A conventional pre-fabricated construction process typically includes the step of fabricating a plurality of pre-fabricated components and the step of transporting, installing and/or assembling these pre-fabricated components at a designated site to form various structures. The installation of such pre-fabricated components at the designated site typically includes the assembly of one or more pre-fabricated components to form a structure, such as a single-storeyed or multi-storeyed building, with or without roofs. Pre-fabricated components can come in various dimensions, shapes and sizes. The larger a fabricated pre-fabricated component, the less components there will be to assemble. However, this would also mean that the pre-fabricated components will be heavier.

Pre-fabricated components are usually sized or dimensioned according to the allowable loading of the lifting equipment or device for lifting each pre-fabricated component. Conventionally, cranes are deployed at the designated site to reach tall structures and to assemble one or more pre-fabricated components on top of or alongside other pre-fabricated components. There are different types of cranes used in the handling of pre-fabricated component, such as but not limited to, tower cranes, crawler cranes, mobile cranes etc. Regardless of type, a crane typically comprises a main drive unit and a hoist system for lifting a load. The hoist system comprises a boom. The boom of a crane such as crawler crane or mobile crane is inclined at an angle. The ability of a crane to lift a heavy pre-fabricated component is compromised or reduced as the hoist travels to the end of its boom. As such, pre-fabricated components for hoisting by cranes are usually designed to be smaller in size and therefore lighter so that the pre-fabricated components can be hoisted for assembly on site. This results in more pre-fabricated components to be hoisted, which lengthens the installation schedule and may lead to unnecessary delays.

In the deployment of cranes for a construction process, sequencing of tasks is typically done from the furthest reach of the crane and end towards the crane. If the task sequencing is done otherwise, the boom of the crane may be obstructed by the constructed portion of the structure. Further, due to the spatial constraints of the lifting site, there may not be sufficient inclination for the crane boom to reach further areas. While utilizing a mobile crane may grant access to some areas inaccessible by tower cranes, a mobile crane does have its constraints. For example, deployment of a mobile crane requires outriggers and counter weights which necessitates a minimum clearance around the mobile crane.

In addition, prior to deployment of any crane, sequence of lift and the lifting plan will be prepared. The lifting plan indicates the tonnage of crane needed, type of lifting gears to be used, lifting method, lifting procedure and lifting details. The cranes can only be deployed or begin lifting after the lifting plan has been formulated or developed.

Each type of crane serves a different function and has its associated advantages. The tower crane is adapted for lifting materials from ground level to higher levels. Once deployed, the tower crane remains in its position until near completion of the building and hence is regarded as a stationary lifting device. The requirement of the height of a tower crane increases along with the building height and the requirement of a counter-weight is configurable based on the lifting load.

The mobile crane is adapted to lifting materials on the same level or a level higher depending on the reach. While it is relatively more mobile compared to the tower crane, for each deployment there is a need for outriggers and counter weights that may require more time and space for deployment.

The crawler crane on the other hand, is similar to the mobile crane, but more easily deployed as hoisting is supported by its own weight and it does not require outriggers for hoisting.

In use of cranes, the crane operator is typically deployed at a distance away from the lifting site, which could be away from his line of sight. The lifting site can be an assembly area and the crane operator may depend on instructions relayed by a signaler proximate or at the lifting site using signal device such as a walkie-talkie. This slows down the overall construction process due to the need for communication between the signaler and crane operator to precisely install the pre-fabricated component into its assigned slot, which may be pre-formed on another pre-fabricated component. In operations where the site is a high rise building or at a high altitude, wind velocity may become a delaying factor as the weight of the pre-fabricated component precludes any manual effort to slow down the wind sway. It also poses a certain safety risk as human labor have to be deployed to stabilize and position the pre-fabricated components, and the crane operator may have to work without sight and hoisting has to be dependent on the instructions of a deployed signal man on site to provide instructions, acting as the 'eyes' of the crane operator.

Further, the boom length of cranes forms an inverse relationship with the weight of the pre-fabricated component. For example, at a boom length of greater than 75 metres (m), the maximum load that can be hoisted will not exceed 1 ton. For a boom length of about 72 m, the load may be increased to about 3.2 ton; at 65 m the load may be increased to 3.8 ton; at 30 m the load may be increased to 9.6 ton; at 15 m the load may be increased to 12 ton; and at less than 15 m the load may be increased to 20 ton. Such inverse relationship is a constraint that affects the sequence of work during construction, requiring more coordination and planning, which in turn requires more manpower and time. In light of the above, there exists a need to reduce installation time, manpower requirements, pre-planning and thus improve the efficiency of a construction process.

There also exists a need to reduce manpower and improve efficiency and safety at a construction site. Accordingly, it is an object of the invention to meet the aforementioned need or alleviate the disadvantages at least in part.

SUMMARY OF THE INVENTION

Definitions: Throughout the specification, unless the context requires otherwise, the word "comprise" or variations such as "comprises" or "comprising", will be understood to imply the inclusion of a stated integer or group of integers but not the exclusion of any other integer or group of integers.

Furthermore, throughout the specification, unless the context requires otherwise, the word "include" or variations such as "includes" or "including", will be understood to imply the inclusion of a stated integer or group of integers but not the exclusion of any other integer or group of integers.

Throughout the description, the term 'pre-fabricated component' and its plural form includes pre-fabricated columns, beams, slabs, walls, etc. The pre-fabricated components may comprise a hollow core or non-hollow core. The pre-fabricated component may include but is not limited to concrete.

Further, the term "pre-assembled components" refers to the assembly of a plurality of pre-fabricated components into a larger component.

Further, the term 'lifting device' includes a device suitable for lifting pre-fabricated components over a distance, and positioning or installing the pre-fabricated components at its desired position or at a designated site, such as on top of another pre-fabricated component or alongside another pre-fabricated component. The lifting device may include manned or unmanned vehicles and/or equipment.

Further, the term 'load' and its plural form includes both pre-fabricated and composite materials. The term 'load' may also include one or more components that are pre-designed or manufactured with complimentary attachments for engagement by lifting devices.

Further, the term 'storey' and its plural form include both covered and non-covered areas. Accordingly, a roof, whether covered or uncovered, may constitute a storey.

The present invention is particularly suited for assembling and/or installing pre-fabricated components at one or more construction sites to form structures. The invention discloses the novel deployment of lifting devices such as forklifts and/or reach stackers deployed at designated locations, in particular partially constructed storeys above a reference level to engage pre-fabricated components and install the same. Such an arrangement advantageously achieves savings in construction time and reduce the need for manual installation and coordination at the designated location by construction workers, thus reducing manpower and workplace accident.

In accordance with an aspect of the invention there is a system for assembling a plurality of pre-fabricated components to form a structure comprising: a first lifting device for transporting at least one pre-fabricated component from a source to a designated site; a second lifting device for engaging the at least one pre-fabricated component at the designated site; wherein the second lifting device comprises an engagement means to engage a portion of the at least one pre-fabricated component for installation at the designated site, and wherein the engagement means is capable of moving the engaged pre-fabricated component in at least two degrees of motion.

In some embodiments, the first lifting device is a lifter.

In some embodiments, the first lifting device is a crane.

In some embodiments, the crane is a crawler crane, a tower crane or a mobile crane.

In some embodiments, the second lifting device is a lift truck. In some embodiments, the lift truck may be a reach stacker or forklift.

In some embodiments, the engagement means of the second lifting device is a mechanical attachment.

In some embodiments, the mechanical attachment of the second lifting device comprises an adjustable head mount arranged to engage a portion of the pre-fabricated component prior to lifting the pre-fabricated component.

In some embodiments, the mechanical attachment of the second lifting device comprises a head mount and a hydraulic system to facilitate movement in the at least two degree of motion.

In some embodiments, the two degrees of motion includes linear motion and rotational motion.

In some embodiments, the second device is further equipped with an image capturing device and an alignment assistance means In some embodiments, the first lifting device and second lifting device are reach stackers.

In some embodiments, the first lifting device is a tower crane and the second lifting device comprises a plurality of reach stackers.

In some embodiments, the first lifting device is deployed at a reference level. In some embodiments where the reference level is the source, the structure comprises multiple storeys and the designated site is a storey above the reference level.

In some embodiments, the first lifting device operates to position the second lifting device at the storey above the reference level.

In some embodiments, the system further comprises an access ramp for the second lifting device to move between the multiple storeys.

In some embodiments, the pre-fabricated components comprise at least one or more pre-fabricated columns and/or one or more pre-fabricated slabs.

In some embodiments, each of the storey above the reference level comprises at least a portion surrounded by a temporary barrier.

In some embodiments, each of the storey above the reference level comprises at least a portion surrounded by a permanent barrier.

In some embodiments, the permanent barrier is a parapet wall.

In some embodiments, the parapet wall is completed before the multi-storeyed framework is completed.

In accordance with another aspect of the invention there is a method for assembling a plurality of pre-fabricated components to form a structure comprising the steps of:— i. transporting by a first lifting device at least one of the plurality of pre-fabricated components from a source to a designated site; and ii. engaging by a second lifting device the at least one pre-fabricated component at the designated site; and iii. installing the pre-fabricate component at the designated site;

wherein the second lifting device comprises an engagement means to engage a portion of the at least one pre-fabricated component and wherein the engagement means is capable of moving the engaged pre-fabricated component in at least two degrees of motion.

In some embodiments, the engagement means attachable to the second lifting device comprises a plurality of locks, each of the plurality of locks operable to mate with a portion of the pre-fabricated component. At least one of the plurality of locks may be a twist lock. In some embodiments, the twist lock comprises a lock cage. In some embodiments, the portion of the pre-fabricated component comprises a pre-prepared protrusion dimensioned for engagement by a lock arrangement. The pre-prepared protrusion may be a pre-cast protrusion.

Another aspect of the invention discloses one or more attachments or engagement device for use by the lifting devices/lifters to engage pre-fabricated components. The pre-fabricated components may be pre-prepared with protrusions or apertures to mate with one or more lock portions of the attachment. The protrusions may be sawn-off or removed once the pre-fabricated component is installed. Such an attachment for engagement of pre-prepared pre-fabricated components further enhance efficiency and reduce installation time.

The engagement device may comprise a coupling mechanism operable to couple with the lifting device; the coupling mechanism comprises a rotator arm operable to rotate the engagement device relative to the lifting device; a load engagement mechanism comprising a plurality of locks to mate with corresponding portions on a pre-prepared load; and a length adjustment mechanism to vary the distance between the plurality of locks; wherein the plurality of locks comprise at least one twist lock mechanism to engage the corresponding portions on the pre-prepared load.

In some embodiments, the length adjustment mechanism comprises a hollow shaft and two hydraulic arms; each of the two hydraulic arms having at least one lock attached to an end thereof, the hydraulic arms operable to slidably move relative to the hollow shaft to vary the distance between the plurality of locks.

In some embodiments, the plurality of locks comprise a protrusion or a lock cage.

In another aspect of the invention there comprises a method for engaging a pre-fabricated component by a lifting device for installation at a designated site, comprising the steps of i. laterally engaging a portion of the pre-fabricated component by at least a portion of the lifting device, the pre-fabricated component comprises at least one protrusion or aperture; ii. locking the engaged pre-fabricated component; iii. installing the pre-fabricated component at the designation site; and iv. removing the at least one protrusion or aperture.

In some embodiments, the step of locking includes a twisting step after engaging the portion of the pre-fabricated component.

BRIEF DESCRIPTION OF DRAWINGS

The present invention will now be described, by way of example only, with reference to the accompanying drawings, in which:

FIG. 6*a* illustrates an attachment having a base frame, a vertical plate and an attachment head, according to a first embodiment;

FIG. 6*b* illustrates the base frame and the vertical plate in FIG. 6*a;*

FIG. 6*c* illustrates the attachment head in FIG. 6*a;*

FIG. 6*d* illustrates another attachment according to a second embodiment;

FIG. 6*e* illustrates the attachment in FIG. 6*d* as viewed from a front thereof;

FIG. 6*f* illustrates a different view of the attachment in FIG. 6*d;*

FIG. 6*g* illustrates an attachment according to a third embodiment;

FIG. 7*a* illustrates the attachment according to the fourth embodiment;

FIG. 7*b* illustrates a first locking mechanism that can be used in the attachment in FIG. 7*a;*

FIG. 7*c* illustrates a second locking mechanism that can be used in the attachment in FIG. 7*a;*

FIG. 7*d*-7*f* illustrate the second locking mechanism in FIG. 7*c;*

FIG. 7*g* illustrates a pre-fabricated column that can be engaged and lifted using the attachment in FIG. 7*c;*

FIG. 7*h* illustrates the pre-fabricated column in FIG. 7*g* being engaged and lifted using the attachment in FIG. 7*a*.

Other arrangements of the invention are possible and, consequently, the accompanying drawing is not to be understood as superseding the generality of the preceding description of the invention.

PREFERRED EMBODIMENTS OF THE INVENTION

In accordance with an aspect of the invention there is a system 10 for assembling a plurality of pre-fabricated components at a designated site. The designated site may be a construction site where a plurality of pre-fabricated components are transported and deposited prior to construction or assembly. The pre-fabricated components may be deposited or stored at a specified storage location of the designated site.

The system 10 comprises a plurality of lifting devices 12 suitable for lifting the at least one of the plurality of pre-fabricated components for installation at a designated site or area. The plurality of lifting devices 12 comprises at least a first lifting device for lifting or transporting the pre-fabricated components from the specified storage location to the designated site (stage 1 'rough' transport process); and at least one second lifting device for assembling or installing the pre-fabricated components at the designated site, such as, but not limited to, onto or alongside other pre-fabricated components (stage 2 'fine' adjustment and installation process). Such an arrangement is advantageous over the prior art in that the transportation, installation and assembly of the pre-fabricated component is broken down into at least two stages to reduce overall manpower requirements and improve safety.

In various embodiments, the first lifting device may include 'lifters' such as cargo lifts, make shift of temporary lifts for transporting pre-fabricated construction material/equipment. The first lifting device may also include cranes and lift trucks.

Figure 1:
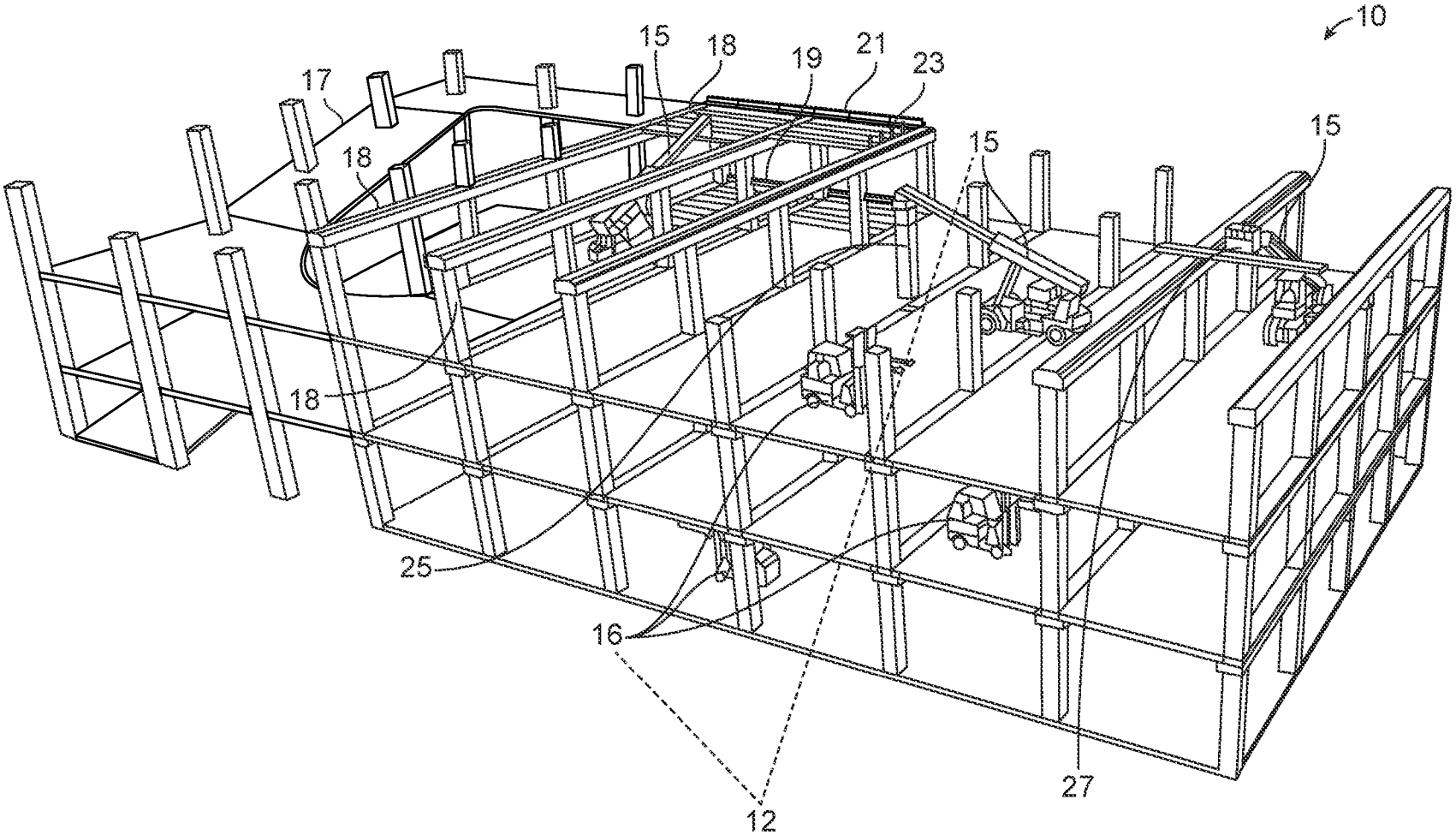
FIG. 1 illustrates the deployment of a lifting devices in the form of stackers and forklifts at the designated site in accordance with an embodiment of the invention.

With reference to FIG. 1, the second lifting device comprises one or more reach stackers 15 and forklifts 16. In the embodiment illustrated in FIG. 1, the construction process to be completed is a multi-storeyed structure. As can be seen, the reach stackers 15 and forklifts 16 are deployed in various positions for stage two fine adjustment and installation. The pre-fabricated components include columns 25 and beams 27 for forming a floor area and roof cover. In the embodiment as illustrated in FIG. 1, the reach stackers 15 and forklifts 16 are deployed for both stage one transportation and stage two installation and adjustment.

To facilitate installation at stage two, lift trucks such as reach stackers 15 and/or forklifts 16 may be further equipped with attachment means for engaging a portion of the pre-fabricated components in various direction or orientation. As examples, the pre-fabricated components may be engaged laterally, longitudinally or from the top or bottom. These lift trucks have low or multiple masts instead of booms and can be positioned directly on each floor level where the components are to be slotted or assembled. Because of proximity, the driver can easily maneuver the components over one or more slots for installation. The lift trucks may also be equipped for lateral shifting to facilitate any fine positioning needed.

The attachment means function to stabilize and maintain the pre-fabricated component at a position during installation. Such attachment means may be in the form of adjustable brackets having lugs, metal engagement flanges or the like to engage a portion of the pre-fabricated component. The adjustable brackets may also be made rotatable to facilitate installation. Some of the pre-fabricated components may be designed with complimentary fittings for assembly, such as pre-arranged studs, while the base of pre-fabricated column are fabricated with complimentary holes for installation onto the studs. The columns are then hoisted by the reach stackers 15 and/or forklifts 16 to fit into the studs through lift, rotate and engage steps. Depending on the type of second lifting device, such as a reach stacker or a forklift, the attachment means is adaptable to various type of attachment for respective use for lifting, turning, and minute adjustment for installation of the pre-fabricated components. It is to be appreciated that these motion for engagement and installation include two or more of the degree of freedom of motion (degree of motion): up and down motion; left and right motion; forward and backward motion; Swiveling; tilting; and pivoting.

In some embodiments, the existing engagement means (forks) of some lifting trucks such as forklifts may suffice for stage two installation and fine-tuning without the need for further attachment mechanisms.

Figure 6A:
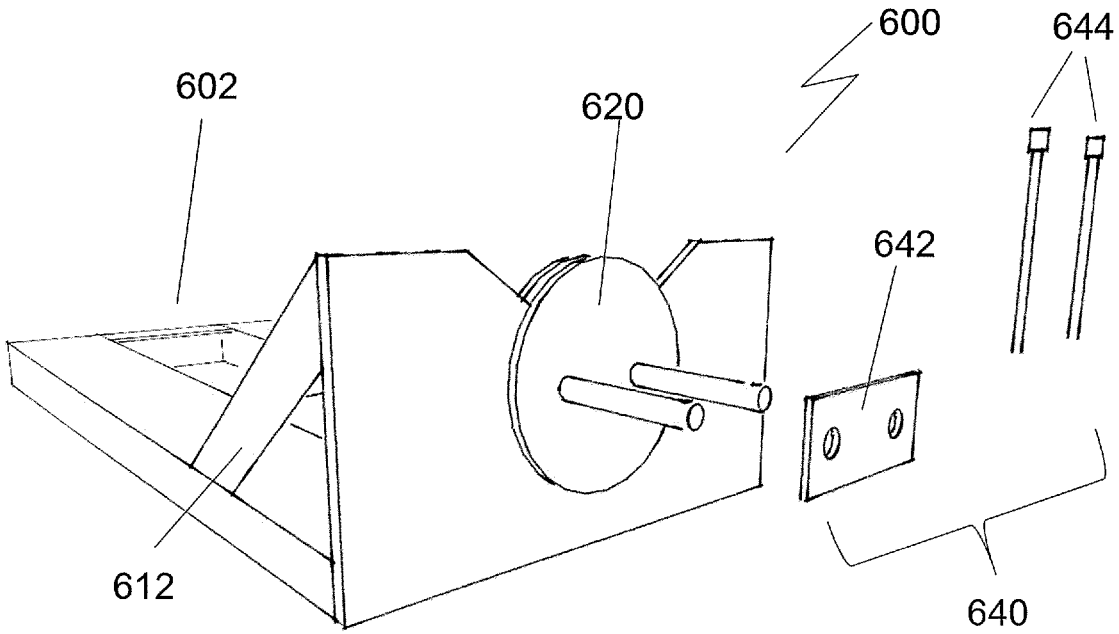
FIG. 6*a*-6*g* illustrate various attachments for use with one or more second lifting devices.
Figure 6B:
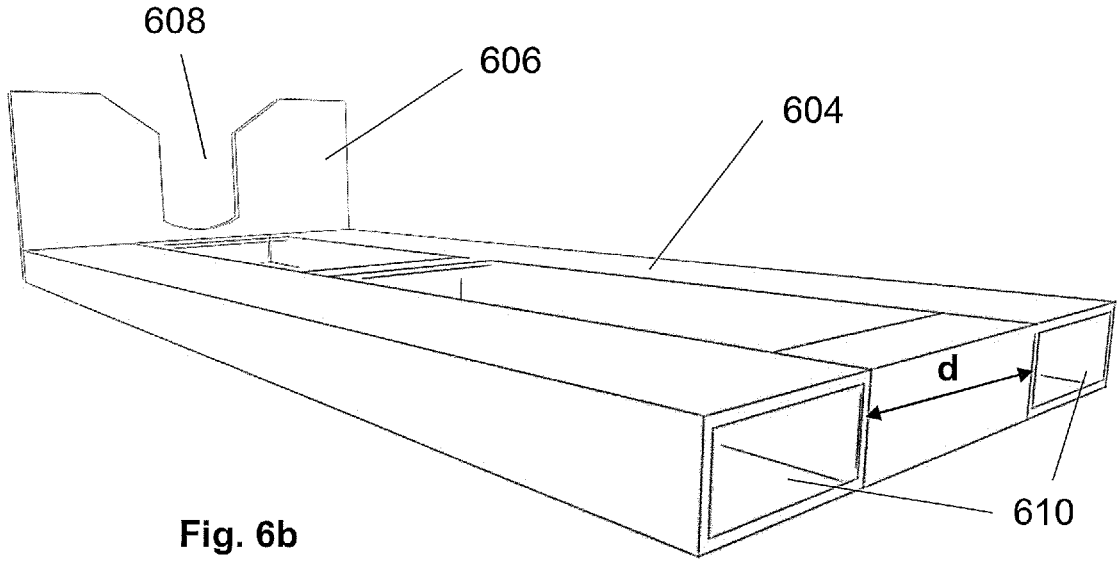
Figure 6C:
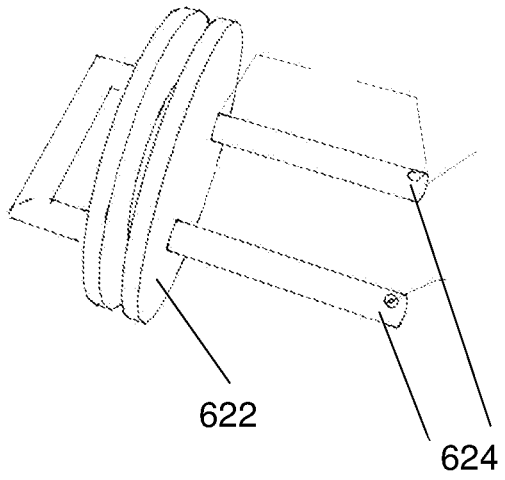

In some embodiments, the attachment means may include attachment devices suitable for forklifts as illustrated in FIG. 6*a*-6*g*. Referring to FIGS. 6*a* to 6*c*, there comprises a base frame 602, an attachment head 620, and a safety mechanism 640.

The base frame 602 may have an L-shaped structure formed by a horizontal base 604 and vertical plate 606 extending from one end of the horizontal base 604. The vertical plate 606 comprises a slot 608 shaped and dimensioned to receive the attachment head 620 such that when the attachment head 620 is received within the slot 608, the attachment head 620 is rotatable within the slot 608. The horizontal base 604 comprises a plurality of slots 610, each slot 610 spaced apart from another slot 610 by a suitable distance so as to slidably receive the forks of a forklift.

Attachment head 620 comprises a base circular plate 622 and a plurality of elongated rods 624 protruding from the base circular plate 622. The plurality of elongated rods 624 are adapted to engage a pre-fabricated component.

In operation, once the horizontal base 604 is engaged by a forklift, the forklift moves to the designated location to engage a pre-fabricated component via the attachment head 620. Once engaged, height adjustment may be achieved through controlling the forks of the forklifts, and rotation and installation facilitated by controlling the rotational movement of the attachment head 620.

To maintain the structural integrity of the L-shaped base frame 602, diagonal trusses 612 may be attached to a portion of the horizontal base 604 and a portion on the vertical plate 606.

The safety mechanism 640 comprises a safety pin plate 642 and a plurality of safety pins 644, working in tandem to secure the attachment head 620 to the vertical plate 606.

Figure 6D:
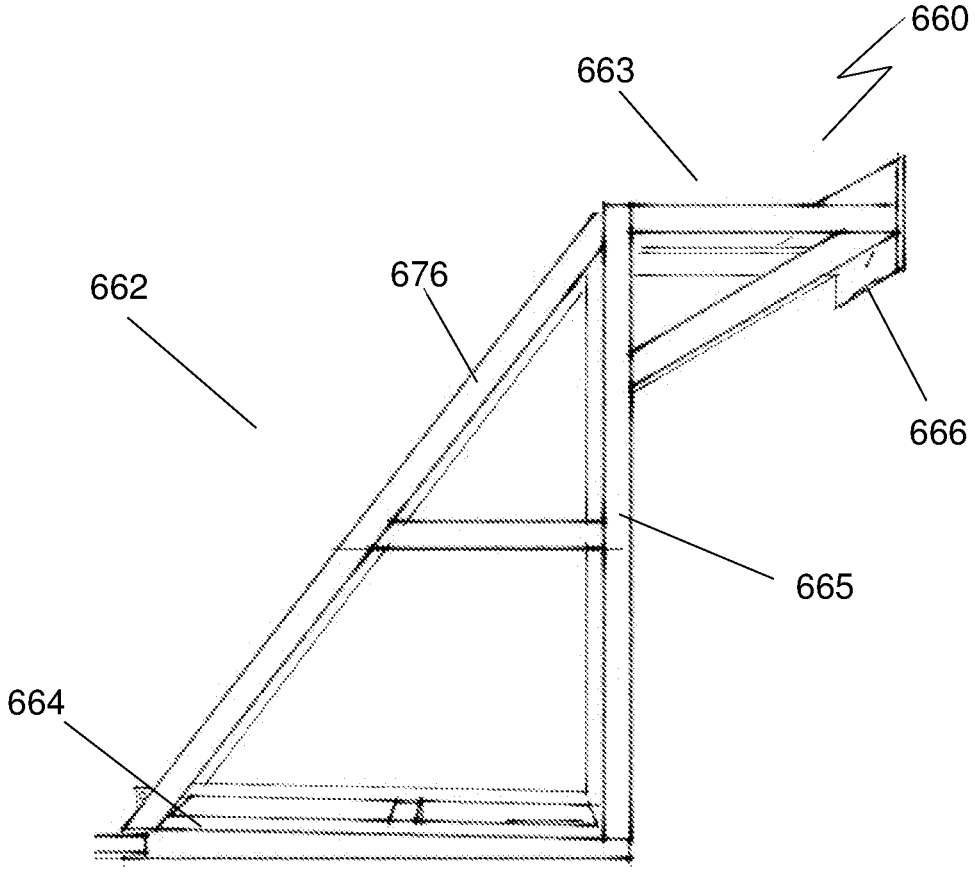
Figure 6E:
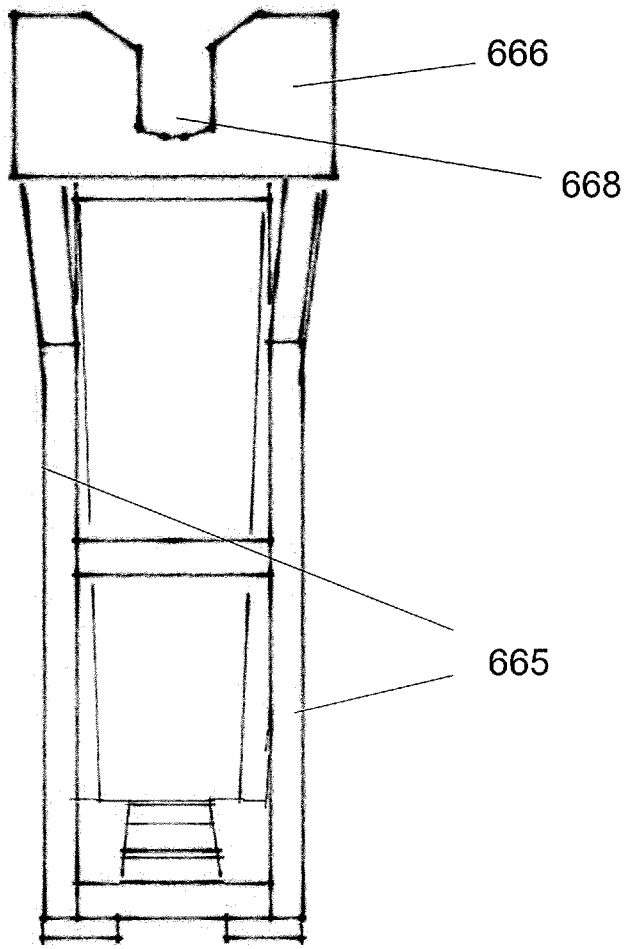
Figure 6F:
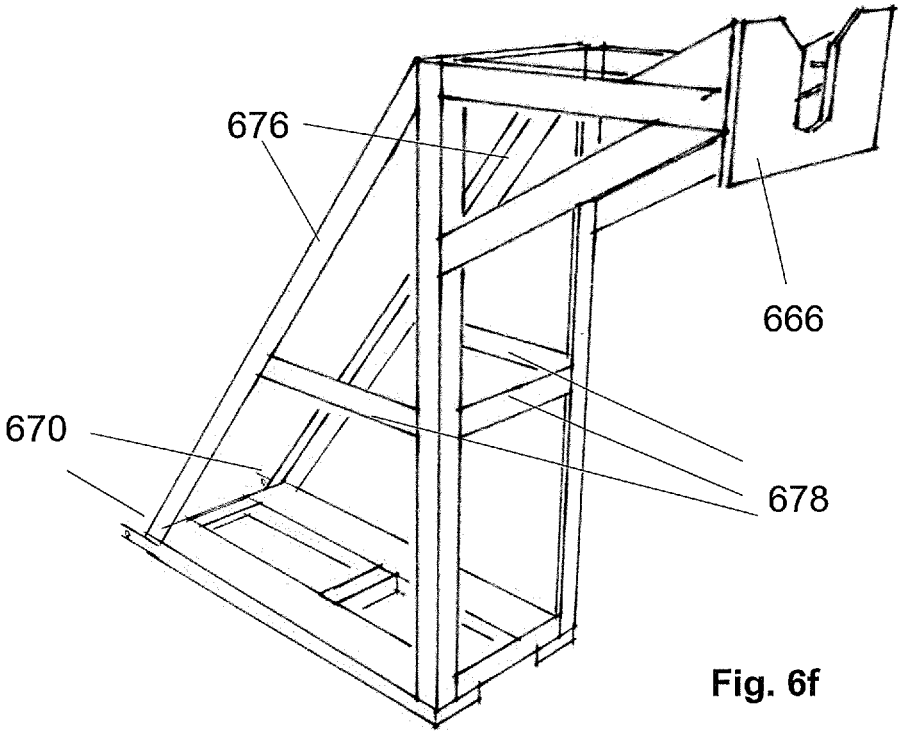

Another embodiment of the attachment device 660 is shown in FIG. 6*d* to FIG. 6*f*. Relative to the embodiments as depicted in FIGS. 6*a* to 6*c*, the attachment device 660 is suited for engagement, positioning, and installation of the pre-fabricated components at a higher height and comprises a base frame 662 and a secondary frame 663.

The base frame 662 comprises a plurality of horizontal beams 664, vertical beams 665, and diagonal beams 676. The plurality of horizontal beams 664 is arranged such as to form a base structure where vertical beams 665 extend therefrom. In an arrangement, each vertical beam 665 is extended from one end of each horizontal beam 664. Diagonal beams 676 connect from another end of the horizontal beams 664 to one end of the vertical beams 665, forming a triangular structure. Connecting beams 678 may be connected between one horizontal beam 664 and another horizontal beam 664; between one vertical beam 665 and another vertical beam 665; and between one vertical beam 665 and a diagonal beam 676 to lend structural integrity to the overall base frame 662.

Extending from the base frame 662 is the secondary frame 663. The secondary frame 663 extends horizontally from one end of the vertical beams 665 and functions as a support structure for a vertical plate 666 to be attached therefrom.

The vertical plate 666 is similar to the vertical plate 606 and comprises a slot 668 shaped and dimensioned to receive the attachment head 620 such that when the attachment head 620 is received within the slot 668, the attachment head 620 is rotatable within the slot 668. The horizontal beams 664 comprises a plurality of slots 670, each slot 670 spaced apart from another slot 670 by a suitable distance so as to slidably receive the forks of a lifting device such as a forklift.

The above embodiments are especially suited to engage pre-fabricated components such as wall panels and rotating the same for installation.

Figure 6G:
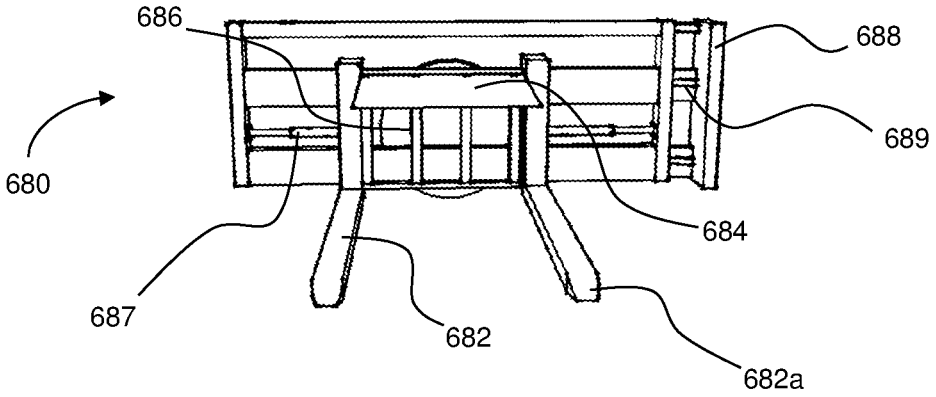

Another embodiment of attachment is illustrated in FIG. 6*g*. The attachment 680 comprises a first support in the form of forks 682 for engaging and supporting the weight of the pre-fabricated component in a first orientation, e.g. horizontal orientation, and a plate 684 arranged to rest on the pre-fabricated component such that in operation the pre-fabricated component is sandwiched between the plate 684 and the forks 682. The forks may comprise tapered or sloped ends/tips 682*a* to facilitate sliding engagement of the forks 682 with the pre-fabricated component or load.

A hydraulic mechanism 686 may be positioned between the forks 682 and plate 684 to bring the plate 684 toward the forks 682, thereby providing a clamping force to hold the pre-fabricated component in place and minimize movement of the pre-fabricated component between the forks 682 and plate 684. Attachment 680 further comprises a second support in the form of a base flap 688, such that when the pre-fabricated component is rotated to a second orientation, e.g. vertical orientation, an edge of the pre-fabricated component may rest on the base flap 688 to minimize the occurrence or prevent the pre-fabricated component from slipping off the attachment 680. At a point of installation, base flap 688 may be retracted or pivoted as part of a release step for the pre-fabricated component to be installed. Other hydraulic mechanisms such as hydraulic arms 687, 689 may be disposed to extend the length of the attachment 680 by sliding the base flap 688 toward or away from the main frame 681 and actuate the base flap 688 respectively.

Figure 7A:
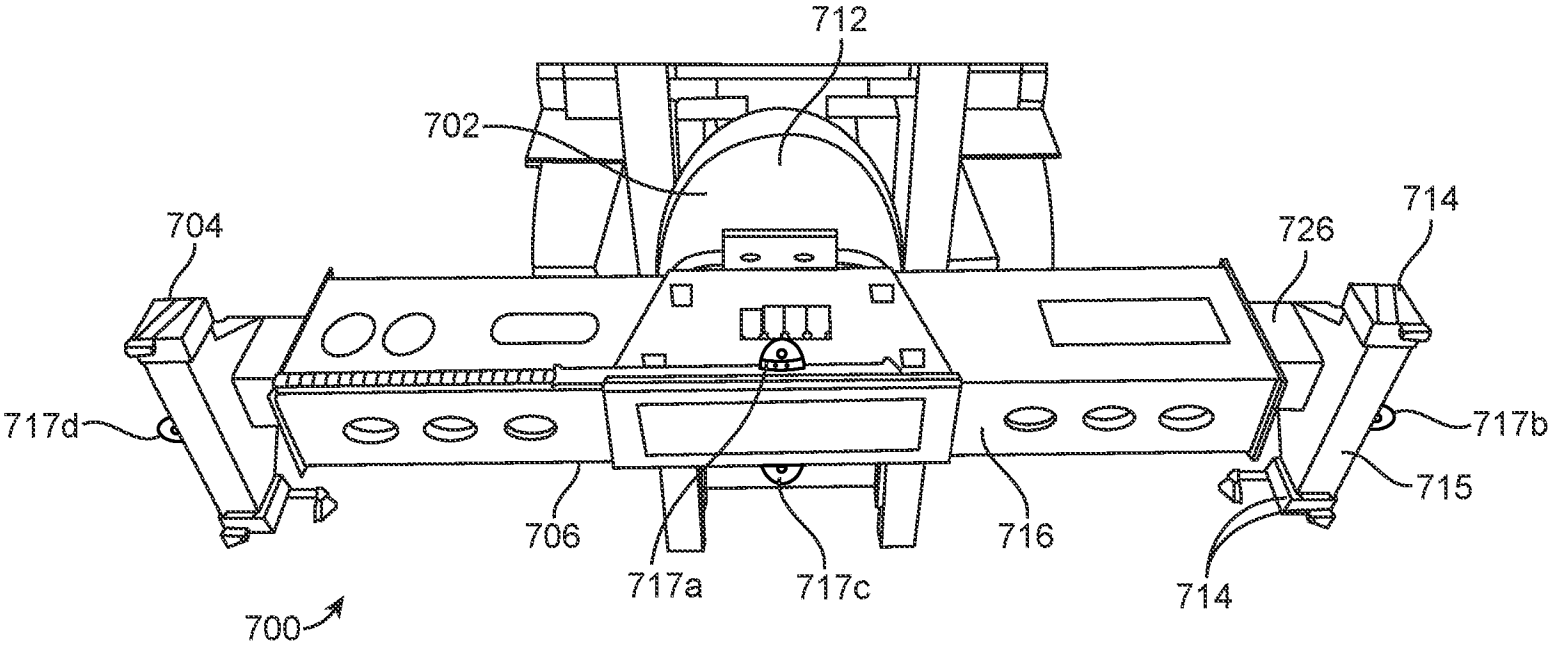
FIG. 7*a*-7*h* illustrate a fourth embodiment of attachment for use with one or more lifting devices.

FIG. 7*a* shows another embodiment of an attachment 700 for use with lifting devices such as a fork lift or stacker. The attachment 700 may be a spreader. Attachment 700 comprises a coupling mechanism 702 for coupling with the lifting device; a load engagement mechanism 704 for engaging a load; and a length adjustment mechanism 706 to vary one dimension (e.g. length) of the attachment 700 so as to cater to loads of varying dimensions.

The coupling mechanism 702 comprises a rotator arm having a rotatable portion 712 engageable by a portion of the lifting device. In some embodiments, the rotatable portion 712 may preferably comprise a swivel mechanism for attachment to the lifting devices. The length adjustment mechanism 706 comprises a hollow shaft 716 arranged to contain at least portions of two hydraulic arms 726 therein, the two hydraulic arms 726 operable to slidably move relative to the hollow shaft 716. Positioned at the end of the two hydraulic arms 726 are two load engagement mechanisms 704. Such an arrangement allows the attachment 700 to cater to different size and length of loads (such as pre-fabricated components) by varying the distance between the two hydraulic arms 726.

Figure 7B:
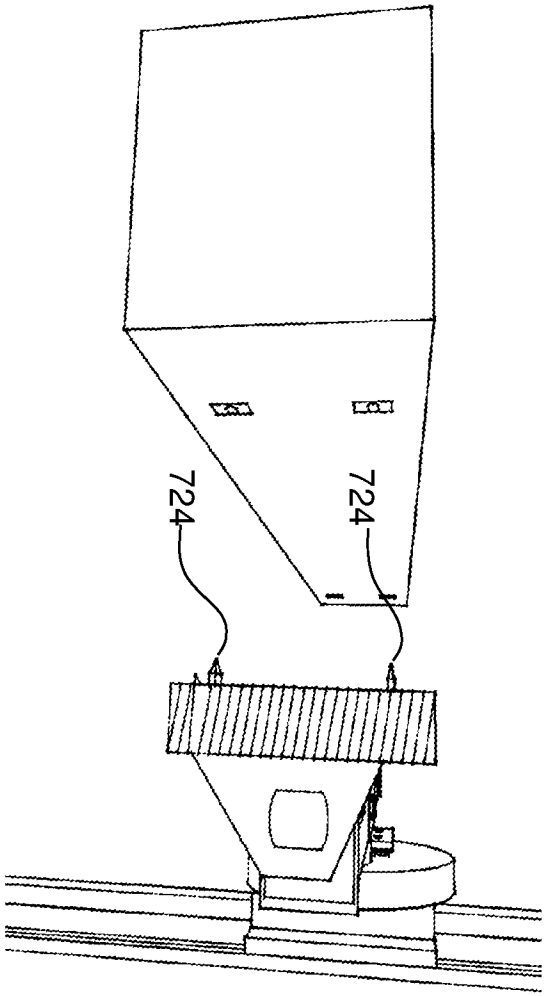
Figure 7C:
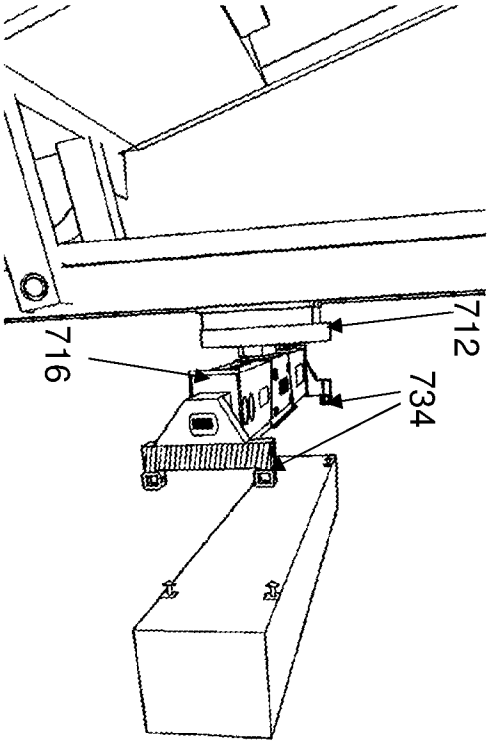
Figure 7D:
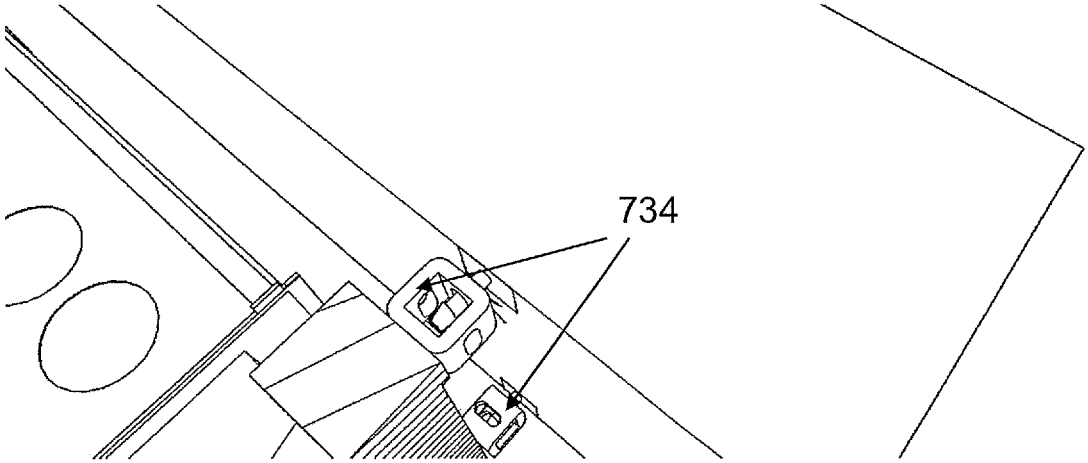
Figure 7E:
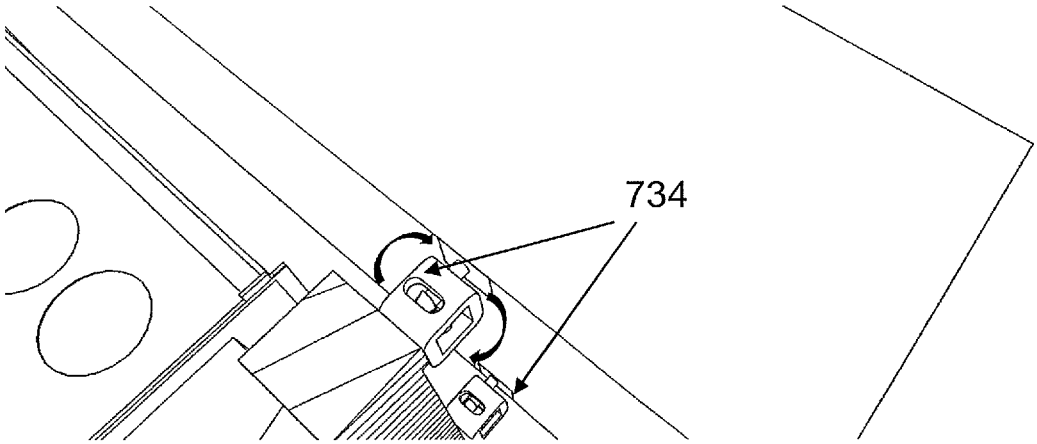
Figure 7F:
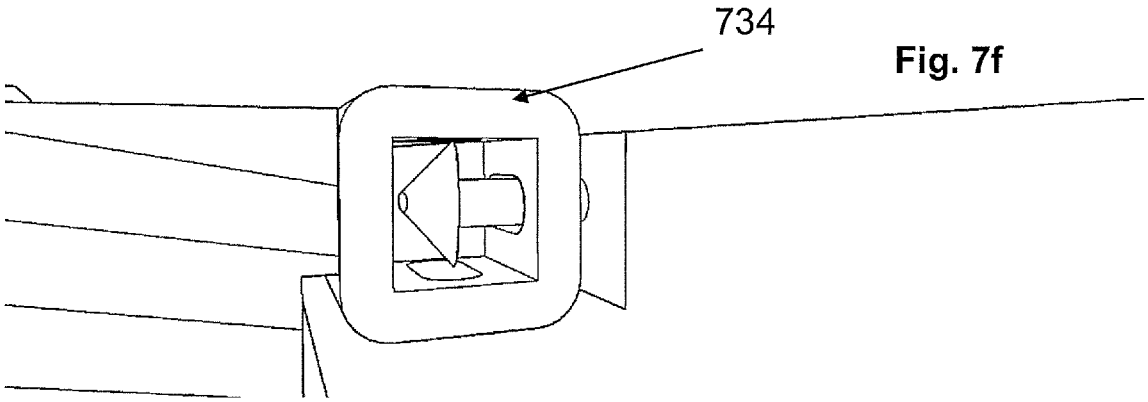
Figure 7G:
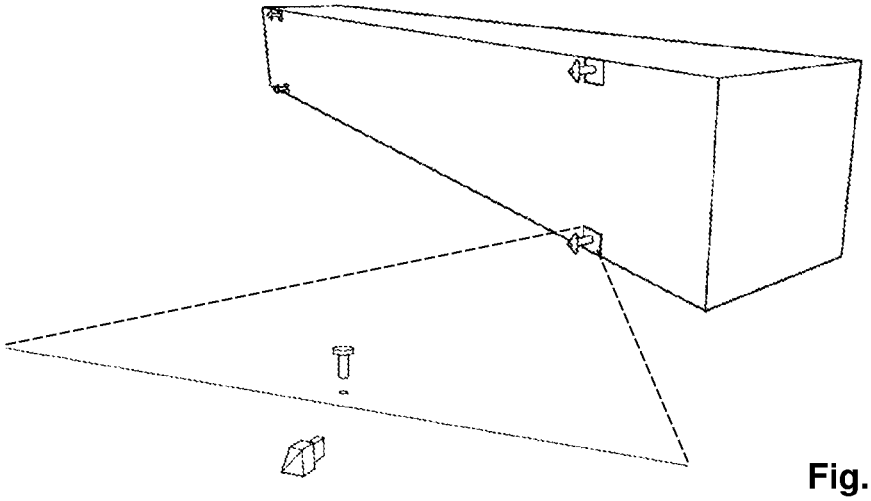

The load engagement mechanism 704 comprises a plurality of locks/locking mechanism. For example there comprises two twist locks 714 disposed at each corner of the hydraulic arm 726, making a total of four twist locks 714. The two twist locks 714 at each corner may be separated by an adjustable beam 715 to adjust the length between the two twist locks 714. Each twist lock 714 comprises at least one protrusion 724 for engaging a portion of the load. In the figure shown in FIG. 7*b*, there comprise two protrusions 724 for engaging corresponding portions on a load, for example the pre-fabricated component. The corresponding portions on the pre-fabricated component to be lifted may be drilled with corresponding holes/apertures for engagement by the two protrusions. In alternative embodiment(s) as shown in FIG. 7*c*, the protrusions 724 may be replaced by lock cages 734, and the corresponding portions on the pre-fabricated component may be protrusions for engagement with the lock cage such that once engaged, the protrusions may be sawn or cut off.

It is to be appreciated that the step of engaging the pre-fabricated component by the at least one protrusion 724 or lock cage 734 comprises at least two-steps. The first step comprises an insertion step where the protrusion 724 or lock cage 734 will engage the corresponding portion on the pre-fabricated component. This is enabled via slots which is compatible and/or aligned to the shape and dimension of the corresponding portion(s) on the pre-fabricated components. The second step comprises a twisting step where the protrusion 724 or lock cage 734 (as the case may be) are rotated in a clockwise or an anti-clockwise direction such that the slots are misaligned with the shape and/or dimension of the corresponding portion on the pre-fabricated component after the insertion step. Such a step of rotation or 'twisting' and creating the misalignment prevents the engaged portion from slipping off when the lifting device is moving. Various embodiments of the slots and protrusions combination are shown in FIG. 7*c* to FIG. 7*g*. In particular, the corresponding portion(s) on the pre-fabricated component for engagement with the protrusion 724 or lock cage 734 may comprise protrusions of different shapes and dimensions as shown.

Figure 7H:
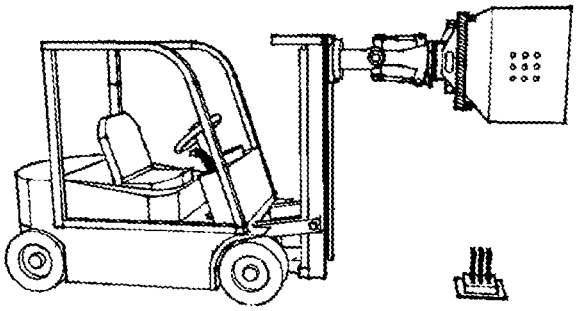
Figure 7I:
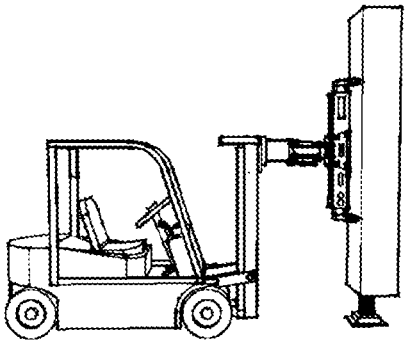
FIG. 7*i* illustrates the pre-fabricated column in FIG. 7*h* being rotated by 90 degree.

FIGS. 7*h* and 7*i* show the use of the attachment on the second lifting device during installation of a pre-fabricated column.

In some embodiments, the positioning of the multiple protrusions 724 may be fixed in a same configuration when lifting and moving all precast components. Such an arrangement is advantageous to provide a one-attachment-fit-all precast components of differing size. In this case, the uniformity could bring about efficiency and increased productivity as there is no necessity to adjust the positioning of the multiple protrusions 724.

Figure 2:
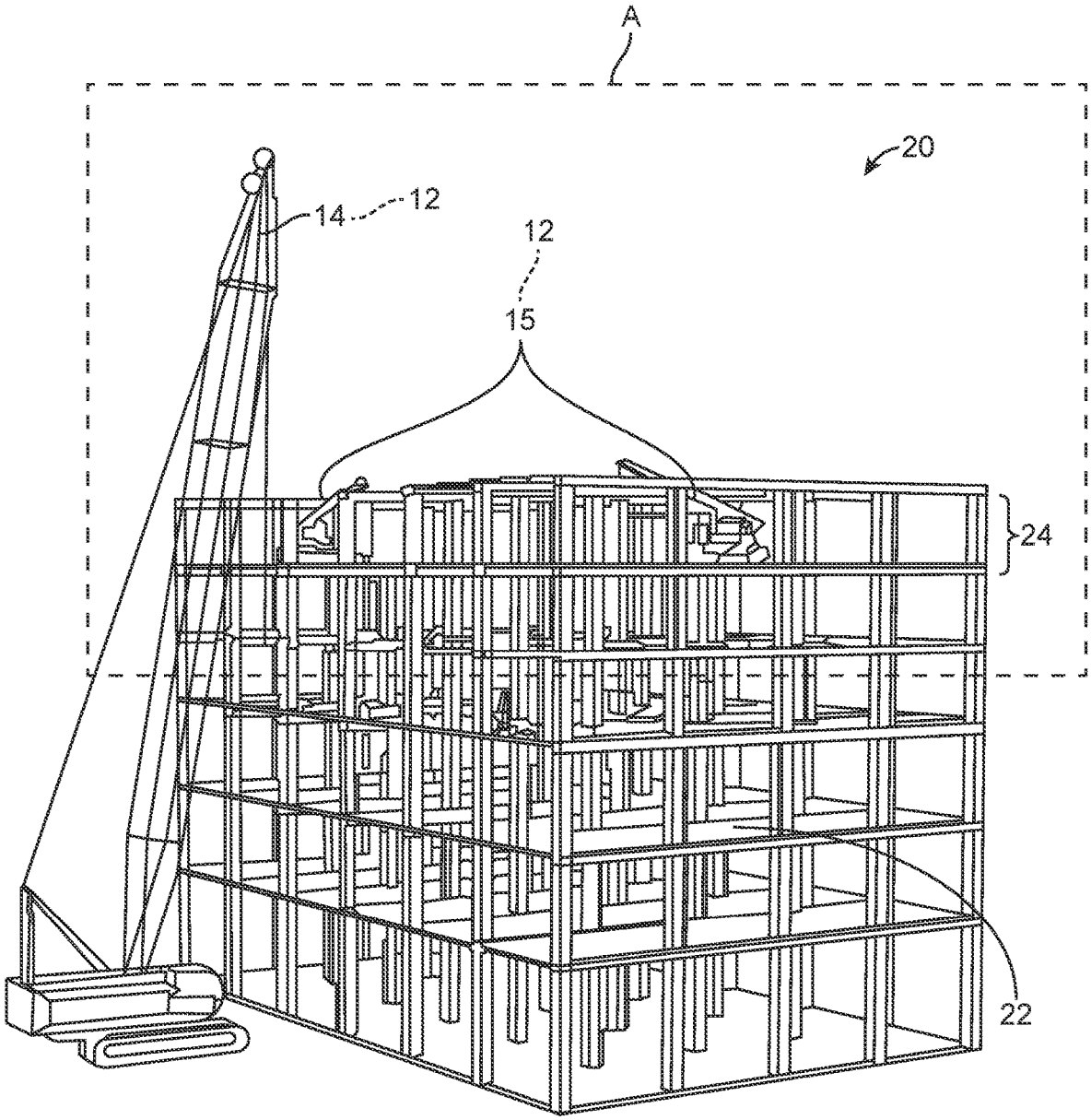
FIG. 2 illustrates an arrangement of the system comprising a tower crane and a plurality of reach stackers deployed on site in accordance with another embodiment of the invention.

FIG. 2 shows another embodiment of a system 20 where the pre-fabricated components have been partially assembled or constructed to form a multi-storeyed structure, such as a high-rise building. In the embodiment of FIG. 2, a first lifting device in the form of crawler crane 14 is deployed at a reference level on site. In other embodiments, the reach stackers 15 and forklifts 16 are deployed for both stage 1 transportation and stage 2 installation and adjustment, where there is a ramp to provide access to various stories (not shown). A second lifting device 12, in the form of one or more reach stackers 15, are positioned at a floor area 22 at a selected storey 24. In the embodiment illustrated in FIG. 2, two second lifting devices, in the form of reach stackers 15, are deployed at the top-most storey of the multi-storeyed structure and operable to hoist or lift one or a plurality of pre-fabricated components for construction and installation at the respective storeys.

The floor area 22 of a storey 24 is above the reference level supported by at least one pre-fabricated component, but usually two or more pre-fabricated columns for added strength. To meet safety and operational requirements, the floor area of each storey where at least one second lifting device, e.g. a reach stacker 15 can be deployed on should have enough loading strength to withstand the weight of the reach stacker 15. In the calculation of the loading capacity of the floor area/slabs, care should be taken to ensure that the loading of the floor slab is suitable for the reach stacker or forklift with load, and not merely just the weight of the second lifting device alone (in other words, the prefabricated component has to be within the handling capacity of the forklift).

In the embodiments where the structure is a multi-storeyed high-rise building, temporary structures for propping of the lower storeys using one or more formwork systems that may be introduced before the second lifting device(s) work on the upper storeys. An example of such formwork system may be formed using a plurality of stackable truss frames for height adjustment, with at least one stackable truss frame having longitudinal beams, transverse joists engagement flanges/structs arranged so that the stackable truss frame may be easily engaged by the second lifting device such as a forklift or reach stacker. In some embodiments, each longitudinal beam, transverse joist may be spaced apart from another longitudinal beam, transverse joist such as to allow lateral engagement by the forks of a forklift.

Depending on the structural design of the slabs which form the floor area, the system can be duplicated in different structures and buildings. In areas with lower structural loading, lighter but similar lifting devices and attachment with complimentary sized components for installation may be utilized.

In the arrangement of FIG. 2, the crawler crane is the first lifting device utilized for stage one of the process, while the reach stackers 15 are second lifting devices deployed for stage two of the process. Likewise as mentioned in the earlier embodiment, to facilitate installation at stage two, the reach stackers 15 are equipped with attachment means for attaching to a portion of the pre-fabricated components, the attachment means functions to stabilize and maintain the pre-fabricated component at a position during installation.

Figure 3:
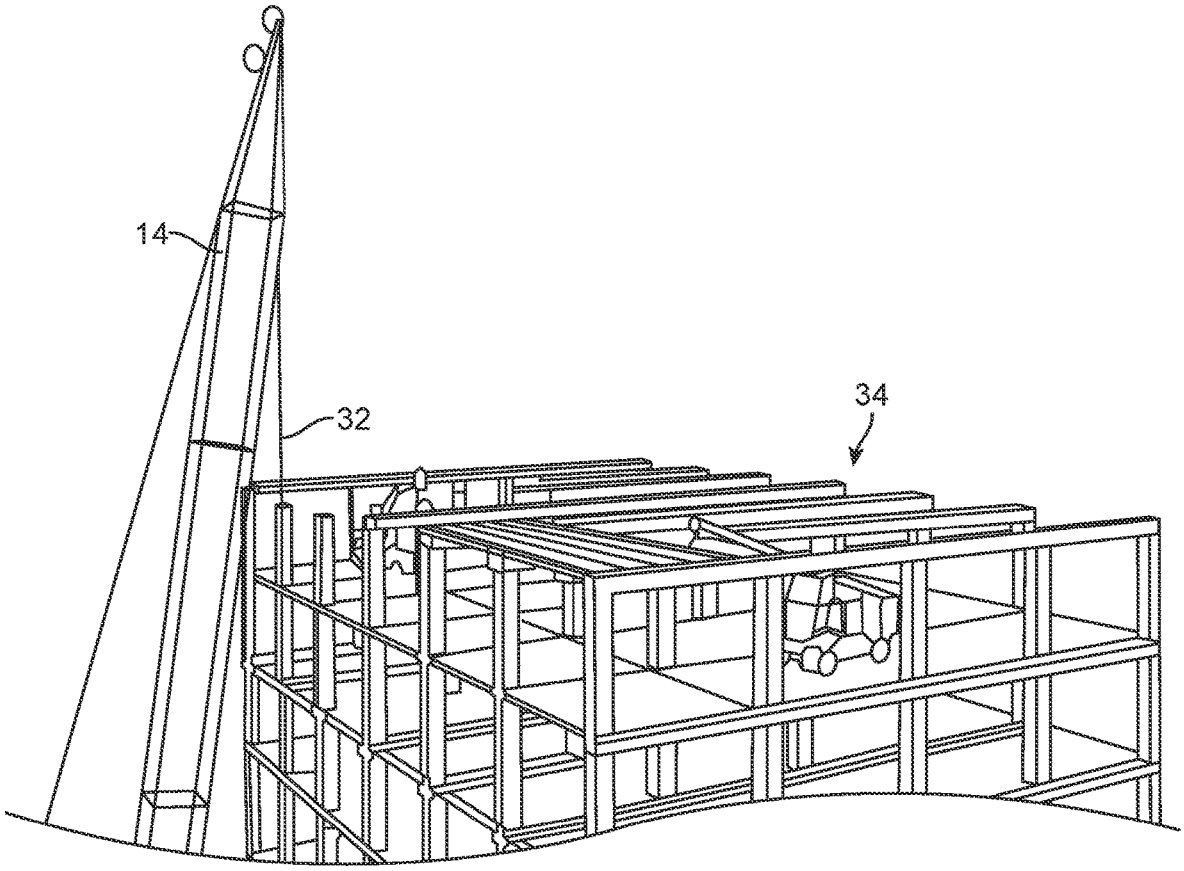
FIG. 3 is an enlarged view of FIG. 2 around the region A.

FIG. 3 shows how a particular combination of different types of lifting devices, including one or more first lifting device (crawler cranes or tower cranes) and one or more second lifting devices, can work in tandem to achieve efficiency and increase productivity at a designated site. In the embodiment shown in FIG. 3, a crawler crane 14 deployed at reference level of the site is utilized to transport, hoist or lift pre-fabricated columns for installation at a portion of a near end 32 of the structure relative to the crawler crane. The boom of the crane is unable to reach the far end 34 of the structure. Reach stacker 15 is deployed at the floor area of the top-most storey for lifting and hoisting the pre-fabricated column for installation at the far end 34 of the structure where the crawler crane 14 cannot reach unless it is being re-positioned, which takes additional time.

Figure 4:
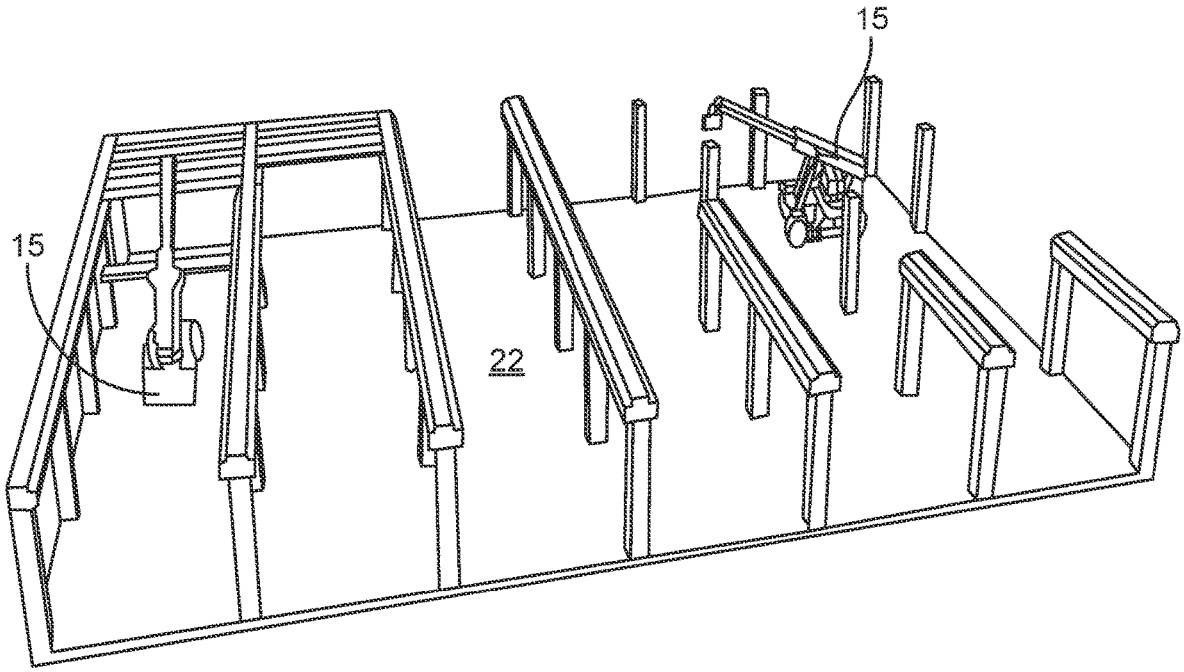
FIG. 4 shows a perspective view of a plurality of reach stackers deployed at a floor area of a multi-storeyed building.

FIG. 4 is an enlarged view of the arrangement in FIG. 3. The arrangement comprises two (or possibly more) reach stackers arranged to hoist or lift pre-fabricated columns and pre-fabricated hollow core slabs for forming a structure. The optimum number of lifting devices that can be deployed on site would depend on one or more of the following factors:

a. Avoidance of over-crowding;
b. Time required to complete each project; and/or
c. Load-bearing capability of each floor area of each storey.

In some embodiments, the pre-fabricated slabs are assembled to form the floor area for the next storey above, or are assembled to form a roof, or cover, for the structure.

In the deployment of one or more first lifting devices for fulfilling the purpose of stage 1, in some embodiments tower cranes are deployed on site as the tower cranes can provide ease of transportation of pre-fabricated components from storey-to-storey in a multi-storeyed structure or building. In construction or assembly of the pre-fabricated components, the tower crane operates to achieve at least the following functions:

a. Lifting/transporting materials between storeys or levels in a multi-storeyed structure;
b. Hoisting of pre-fabricated components or other materials within the radius of the boom length;
c. Installation of pre-fabricated components or other materials within the radius of the boom length.

In some embodiments where the construction site is a multi-storeyed building or structure, the construction or installation may commence from a reference level. The reference level may be the ground or basement storey of the multi-storeyed building. As an example, the multi-storeyed building may comprise a ground (first) storey as the reference level with successive storeys built above the first storey.

In some embodiments, the pre-fabricated components at the reference level or ground storey will include pre-fabricated components in the form of columns, beams and slabs for additional storeys/levels to be built thereon.

In an embodiment, the crane is strategically deployed to lift pre-fabricated components from storey to storey, and a reach stacker will move and assemble the components within each storey.

In some embodiments, a crane may not be necessary where there comprises an access structure to carry pre-fabricated components or other load to each storey. An example of such an access structure is an access ramp.

In other embodiments (not shown), in particular where space is a constraint, instead of the deployment of a crane, such as a tower crane, crawler crane or mobile crane, reach stackers and/or forklifts may be utilized with modification to the work sequence.

In some embodiments where the structure is a multi-storeyed structure, temporary barriers 21, 23 may be constructed and surround a portion of one or more upper storey(s) above the reference level, so as to form a safety barrier when the second lifting devices are deployed in the upper storeys.

In some embodiments, the temporary safety barrier may be in the form of railing(s), wire ropes, and crash barrier(s) and/or a combination thereof to prevent the second lifting devices such as forklifts or reach stackers from falling beyond the edges of the multi-storeyed structure. The material forming the safety barrier(s) may be in the form of steel, plastic, a combination thereof or other types of materials.

In some embodiments, parapet walls 19 which are typically constructed nearing the end of a construction project may be constructed earlier to form a permanent barrier which is strong enough to withstand a moving second lifting device from falling off an edge of the structure or building. In such embodiments, either the full parapet wall 19 is constructed to act as a safety barrier or part of the parapet walls 19 can be erected to serve as a curb to prevent forklift from falling over. Hence where second lifting devices are deployed on multi-storeyed structures, the construction sequence may be modified to enhance safety.

In some embodiments involving multi-storeyed structures, in order to accommodate the second lifting device between storeys, the space between each storey has to provide for a minimum height clearance for the type of second lifting device (e.g. forklift access and installation. In some embodiments, one or more columns or beams of the development have to have sufficient turning radius if forklift is selected as a second lifting device.

In another aspect of the invention there is a method of construction or assembling one or more pre-fabricated components. The method may include the steps of lifting and transporting a plurality of pre-fabricated components to a designated site by a lifting device; and adjusting and installing the pre-fabricated components at the designated site. The step of adjusting and installing the pre-fabricated component may include the sub-steps of lifting and adjusting the pre-fabricated component before installation.

Figure 5:
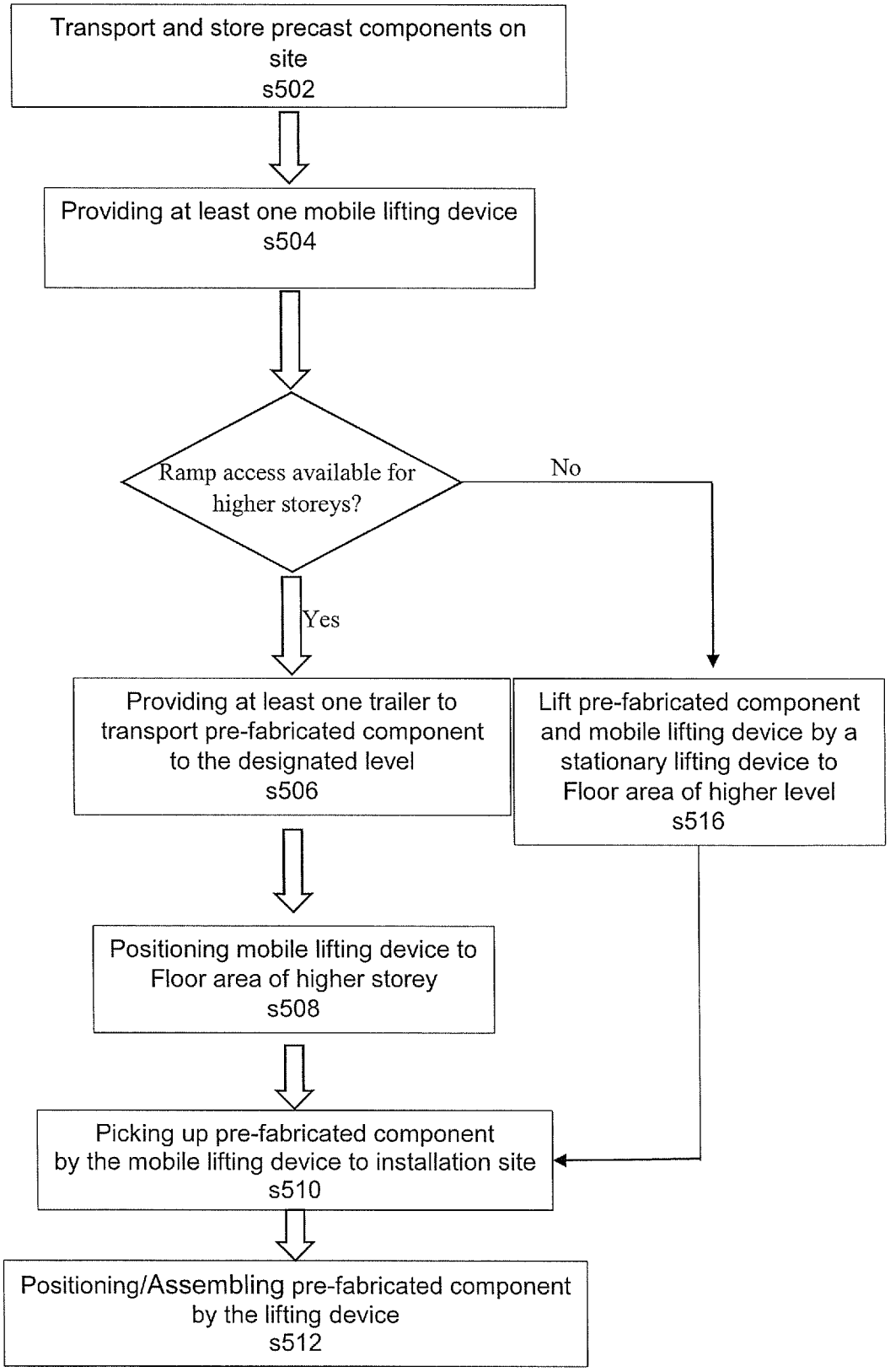
FIG. 5 illustrates a method for assembling a plurality of pre-fabricated components at a designated site.

In various embodiments as illustrated in FIG. 5, the designated site may be a construction site, and the method may include the steps of storing a plurality of pre-fabricated components at a storage site adjacent to the construction site (step s502). The pre-fabricated components may be delivered to the storage site from a source, such as a factory. The next step may be providing at least one lifting device (step s504). The at least one lifting device may include the various types of cranes as well as reach stackers and forklifts.

In some embodiments a plurality of lifting devices such as reach stackers may be deployed in a relay-like configuration or arrangement to lift and transport the pre-fabricated components from the designated secure site to the site for construction the first storey. Such an arrangement reduces construction and/or installation time. In such embodiments, the reach stackers function both to effect transportation (stage 1) and installation (stage 2).

Once the lifting devices are provided, the pre-fabricated components may be transported to the designated site (step s506). The installation and assembly of the pre-fabricated components can then take place. Once installation of the pre-fabricated components at the reference level or storey is completed, the lifting devices may be positioned on a floor area of a higher storey. This may be achieved via the use of one type of lifting device (e.g. crane) to lift other type of lifting device (e.g. reach stacker or forklift) to the desired location (step s516). Alternatively, access ramps 17 may be provided for lifting devices such as forklifts and reach stackers to move between storey(s) (step s508).

In some embodiments, the pre-fabricated component can be lifted one by one (or batch by batch) by a mobile crane from the ground storage location to the second and successive storeys, or, if the access ramp 17 is available, the pre-fabricated components can be loaded and transported via the access ramp 17 to the assigned upper storeys for engagement and pick up by the plurality of reach stackers. The pre-fabricated components lifted by mobile crane or the reach stacker(s) would be stacked at a safe location for other reach stackers to engage for construction and installation.

In various embodiments involving multi-storeyed structures, for the second storey and above, the plurality of reach stackers can be deployed or positioned at the already constructed floor area via an access device/mechanism such as an access ramp 17 (as described in step s508). The access ramp 17 may be constructed before the reach stacker(s) are deployed or may be moved to the site. Alternatively, the reach stackers can be or be lifted to a location/level by other lifting devices such as the mobile crane or tower crane (step s516).

In some embodiments involving multi-storeyed buildings or structures, the method includes the step of positioning or deploying at least one lifting device on the floor area of any one of the plurality of storeys.

Upon being positioned at the desired storey for installation, the lifting device is then deployed to pick up each pre-fabricated component (step s510). The step of positioning pre-fabricated component by the lifting device (step s512) may include installing the pre-fabricated component alongside or on top of other pre-fabricated components. The positioning or installing step may include fine-adjustment involving tilting, rotating and inserting the at least one pre-fabricated component. Such fine-adjustment may be achieved via a mechanical attachment (attachment means) on the lifting means of the lifting device.

In some embodiments, to improve the engagement between the lifting device and the pre-fabricated component, each pre-fabricated component may comprise an attachment, which may be in the form of lugs, hooks, protruding poles and/or holes. The equipment will need to have complimentary attachment to engage the pre-fabricated component through the provisioned means. These attachments on the pre-fabricated components and lifting devices will enhance the effectiveness and accuracy for the lifting device to lift, tilt and position for installation and lifting. The engagement can be performed from the top or lateral.

In some embodiments, the mechanical attachment may include one or more image capturing devices 717*a*-717*d* positioned or located at strategic locations to capture an image or a video of a portion of the pre-fabricated component (e.g. joint) to be attached to another pre-fabricated component. The captured image or video may be fed or streamed to the operator of the lifting device such as reach stacker or forklift to facilitate or aid the precise insertion of a pre-fabricated component alongside or onto another pre-fabricated component during installation.

In some embodiments, the mechanical attachment may be in the form of a bracket comprising a plurality of flanges for engaging a portion of the pre-fabricated component such that the flanges clamp the outer parameter of the pre-fabricated component in use. The plurality of flanges may be brought closer or nearer relative to each other to cater to pre-fabricated components of different dimensions. The bracket may be rotatably mounted on a base, the base which in use is attached to the lifting device 14, 15 or 16. In use the distance between each of the plurality of flange is adjusted to engage a pre-fabricated component, the pre-fabricated component is then lifted to a suitable height and rotated if necessary to engage another pre-fabricated component to complete the installation. If required the image capturing device 717*a*-717*d* is utilized for fine-tune adjustment and precision during installation, thus minimizing the need for additional manual labor.

In some embodiments an alignment assistance means, such as via a laser beam, may be used when one pre-fabricated component is to be installed on another pre-fabricated component. When there is a misalignment, an alarm or indicator may be made and sent to the lifting device operator.

In some embodiment, the lifting device utilized for adjustment and installation may be a remotely operator vehicle, such as an unmanned vehicle.

In some embodiments involving reach stackers, a deployed reach stacker, equipped with the appropriate attachment, can engage the pre-fabricated component(s) laterally or longitudinally for placement on an assigned position, such as a designated slot formed on a pre-fabricated component. In the context of a multi-storeyed building, a reach stacker which is deployed on the second or successive higher storeys will enable its operator, such as a driver, to see the assigned designated slot himself and therefore the driver can easily position the pre-fabricated component over the designated slot under supervision of the site supervisor in charge of construction on that particular storey or level. This can be further assisted by the image-capturing device or alignment means as described. The above arrangement is advantageous in that it does not require an additional personnel to communicate or coordinate the installation process at that particular storey, in contrast to the prior art system where a signaler with a walkie-talkie device is required to establish contact with a crane operator at the reference or ground level.

For lateral side engagement to engage a pre-fabricated component from an lateral position, the reach stacker may be equipped with lateral side shift mechanism which allow the driver or operator to perform fine-tune adjustments via shifting the engaged pre-fabricated component left or right to easily fit the designated slot. Such an arrangement reduces the overall time required to install or slot the pre-fabricated components as compared to hoisting by a mobile crane which require coordination between two or more personnel as well as having to cater to wind/weight sway which slows down precision positioning.

In some embodiments, depending on floor area, two or more second lifting devices such as reach stackers can be assigned to work at different locations on the same storey. Such an arrangement is more difficult to achieve for a mobile crane to be used, as the reach of a mobile crane is typically limited by its boom radius and the angle of placement as well as the building structure which could obstruct/limit its movement. The angle of boom elevation and its reach would also affect the weight capacity of the load. In addition, once a mobile crane is stationed for lifting work, it will be immobilized. A reach stacker of forklift can lift the necessary pre-fabricated component and move at the same time.

In some embodiments, once the construction operation at an assigned storey is completed, the reach stackers could be deployed to the next storey or location via the access ramp 17 (subject to building configuration) or by a mobile crane. The process is repeated until the construction of the multi-storeyed structure or building is completed. The lifting device assisted pre-fabricated construction system was created to address or at least substantially ameliorate deficiencies of existing arrangements including by reducing man-hours in planning, coordination and execution. In the embodiments that involve attachments, the devices with corresponding attachment(s) to lift the pre-fabricated component and a pre-fabricated component shaped and sized to engage the corresponding attachments or the engagement means of the lifting devices provide for additional advantages.

In some embodiments involving the pre-fabricated hollow core slabs (typically used for roofs), the use of tower or mobile cranes are eliminated. In at least one embodiment, both the first lifting device and the second lifting device are reach stackers arranged in a relay. It was found that the deployment of reach stackers compared to crane reduced the manpower by more than 50%, specifically due to the elimination of signal man, rigger man (for outrigger deployment), and lifting supervisor. In addition to the reduction in manpower, up to 45% increase in hollow core slabs can be installed per day. In general, the applicant has discovered that a reach stacker is at least eight times more productive compared to a crane.

In some embodiments, different types of mechanical attachment or attachment means may be utilized for different types of pre-fabricated components. For example, a mechanical attachment may be utilized for lifting pre-fabricated columns, and another mechanical attachment may be utilized for lifting pre-fabricated hollow-core slab. It is to be appreciated that a lifting device such as a reach stacker can be deployed in high-rise buildings, due to its relative light weight and high maneuvering/mobile ability. Instead of using metal materials, owing to its light weight properties, for high rise buildings, pre-fabricated concrete components can be used. This will offer a more economical alternative for the building and construction industry.

In systems utilizing the deployment of tower cranes and where lifting device cannot be deployed on the floor areas of multiple storeys, multi-level sequencing of work is required due to the restriction of the crane boom. To operate a crane, calculation is required to position the pre-fabricated components within its reach. With the light weight and high maneuvering ability of the lifting devices such as reach stackers, coupled with the necessary attachments with lateral or longitudinal engagement properties, sequencing of works will be simplified as the device can access every area on each floor there by allowing construction to be carried out level by level. Such an arrangement is able to eliminate or at least reduce extensive coordination and complicated calculations for hoisting thus saving time on planning.

It is to be appreciated that a reach stacker is a preferred candidate for at least the second lifting device because of its mobility in the construction site and also for its ability to accurately position and install the pre-fabricated components at the designated site (when mounted with the attachment means). Further, the reach stacker is relatively lighter in weight as compared to other types of lifting devices such as crawler cranes, mobile cranes and crawler cranes. The light weight and mobility allows the reach stacker to access various levels of a multi-storeyed structure during construction and reduces the need to change equipment or deploy more people for coordination during the lifting and installation process.

The above is a description of embodiments of systems and methods in accordance with the present invention. It is envisioned that those skilled in the art can design alternative embodiments of this invention that falls within the scope of the invention. In particular, the first and/or second lifting device may include other types of lift trucks, which may include manual lifting equipment with forks. The various embodiments form different systems where different types of first lifting devices such as cranes are used for transportation and rough positioning, and second lifting devices such as reach stackers and/or forklifts are utilized for fine adjustment and installation. The first and second lifting devices work in tandem and in a complimentary manner to reduce manpower, increase productivity. With the use of lifting device that can be deployed at each storey of a high-rise building for assembly of pre-fabricated components, the working radius (and boom length) of tower cranes could be effectively reduced. This translates to increase in ability of the tower cranes to hoist heavier loads. Therefore, each pre-fabricated component can be fabricated to be larger, thereby reducing the total number of components for constructing a structure and thus reducing the man-hours for building construction. Productivity is further improved, as positioning of components is enhanced and less manpower is needed.

In some embodiments, the first and second lifting devices may be one and the same, i.e. the same lifting device may be utilized to transport the pre-fabricated components to the designated site with or without the attachment means, and in the latter case the engagement means is then attached for installation of the pre-fabricated component.

It is to be appreciated that features from various embodiment(s) may be combined to form one or more additional embodiments.

The invention claimed is:

1. A system for assembling a plurality of pre-fabricated components to form a structure comprising:

a first lifting device for transporting at least one pre-fabricated component from a source to a designated site;

a second lifting device for engagement, fine-adjustment and installation of the at least one pre-fabricated component at the designated site;

wherein the second lifting device is adapted to pick up the at least one pre-fabricated component at the designated site; wherein the second lifting device comprises an engagement means to engage a portion of the at least one pre-fabricated component for installation at the designated site, and wherein the second lifting device is a lift truck operable to laterally engage the at least one pre-fabricated component;

wherein the engagement means of the second lifting device comprises a plurality of locks, each of the plurality of locks operable to mate with a portion of the at least one pre-fabricated component, wherein the portion of the at least one pre-fabricated component comprises a pre-prepared protrusion dimensioned for engagement by a lock arrangement.

2. The system of claim 1, wherein the engagement means is capable of moving in at least two degrees of motion.

3. The system of claim 2, wherein the engagement means is a mechanical attachment that comprises a head mount and a hydraulic system to facilitate movement in the at least two degrees of motion and wherein the at least two degrees of motion includes linear motion and rotational motion.

4. The system according to claim 1, wherein where the lift truck is a reach stacker, the reach stacker comprises an adjustable head mount arranged to engage a portion of the at least one pre-fabricated component prior to lifting the at least one prefabricated component.

5. The system according to claim 1, wherein the first lifting device is deployed at a reference level, and wherein the reference level is the source, the structure comprises multiple storeys and the designated site is a storey above the reference level.

6. The system of claim 5, wherein the first lifting device is a crane, the crane operates to position the second lifting device at the storey above the reference level.

7. The system of claim 5, further comprises an access ramp for the second lifting device to move between the multiple storeys.

8. The system of claim 1, wherein the pre-fabricated components comprise at least one or more pre-fabricated columns and/or one or more prefabricated slabs.

9. The system of claim 1, wherein the first lifting device is a tower crane and the second lifting device comprises a plurality of reach stackers and wherein the second device is further equipped with an image-capturing device.

10. The system of claim 5, wherein each storey above the reference level comprises at least a portion surrounded by a temporary barrier, and wherein the each storey above the reference level comprises at least a portion surrounded by a permanent barrier.

11. The system of claim 10, wherein the permanent barrier is a parapet wall, and wherein the parapet wall is completed before the structure comprising multiple storeys is completed.

12. The system according to claim 1, wherein the plurality of locks comprises four twist locks, wherein the distance between two twist locks is adjustable, and wherein the at least one twist lock comprises a lock cage.

13. The system according to claim 1, wherein the pre-prepared protrusion is a pre-cast protrusion.

14. A method for assembling a plurality of pre-fabricated components to form a structure comprising the steps of:

i. transporting by a first lifting device at least one of the plurality of prefabricated components from a source to a designated site; and ii. engaging by a second lifting device for fine-adjustment and installation of the at least one pre-fabricated component at the designated site; and iii. installing the at least one pre-fabricated component, by the second lifting device, at the designated site;

wherein the second lifting device comprises an engagement means to engage a portion of the at least one pre-fabricated component, wherein the second lifting device is adapted to pick up the at least one pre-fabricated component at the designated site and wherein the second lifting device is a lift truck operable to laterally engage the at least one pre-fabricated component; wherein the engagement means of the second lifting device comprises a plurality of locks, each of the plurality of locks operable to mate with a portion of the at least one pre-fabricated component, wherein the portion of the at least one pre-fabricated component comprises a pre-prepared protrusion dimensioned for engagement by a lock arrangement.

15. The method according to claim 14, wherein the engagement means includes four lock cages, each of the four lock cages being operable to mate with a corresponding portion of the at least one pre-fabricated component to allow the engagement means to engage the at least one pre-fabricated component.

16. The method according to claim 15, wherein the corresponding portion of the pre-fabricated component includes a pre-cast protrusion.

* * * * *